United States Patent [19]

Zimmerman

[11] Patent Number: 4,561,128

[45] Date of Patent: Dec. 31, 1985

[54] FUSING APPAREL SEAMS

[76] Inventor: Harry Zimmerman, 6830 Mewall Dr., San Diego, Calif. 92119

[21] Appl. No.: 565,745

[22] Filed: Dec. 27, 1983

[51] Int. Cl.[4] ..... A41D 27/24

[52] U.S. Cl. ..... 2/275; 156/93; 156/306.6

[58] Field of Search ..... 2/275, 269, 243; 161/406

[56] References Cited

U.S. PATENT DOCUMENTS 3,328,809 7/1967 Payne ..... 2/269

3,435,463 4/1969 Jay ..... 2/269

*Primary Examiner*—Doris L. Troutman

*Attorney, Agent, or Firm*—Fulwider, Patton, Rieber, Lee & Utecht

[57] ABSTRACT

A method for making garments having fused seams. A strip of double-sided fusible tape is placed adjacent a seam and the tape is pressed between the seam and an adjacent panel of fabric, a free end of which forms part of the seam, and then the seam is steam-pressed against the panel, bonding the seam to the panel. Alternatively, the tape is placed adjacent the fabric prior to sewing and thereby forms part of the seam.

2 Claims, 4 Drawing Figures

FUSING APPAREL SEAMS

BACKGROUND OF THE INVENTION

1. Field of the Invention

The present invention relates generally to the manufacture of garments, and more particularly to the sewing together of panels of fabric.

2. The Prior Art

Most new garments are pressed and packaged so as to present a neat, attractive appearance when first delivered to a retail customer. In particular, seams formed along the junction lines where panels of fabric are sewn together are flat and smooth. However, after extended periods of wear and repeated washing or cleaning, the seams often pucker and become wavy and billowy. When this happens, the garment usually requires considerable pressing to restore its original appearance, even though in theory the garment was a "permanent press" item.

U.S. Pat. No. 3,435,463, issued to Jay on Apr. 1, 1969, discloses a method for altering permanent-press garments. The method disclosed by Jay can be used to produce, in an existing garment, a new seam having the structure shown in FIG. 3 hereof, wherein free end 2*a* of panel 2 is bonded to panel 2 by means of a fusible strip 1, and free end 3*a* of panel 3 is bonded to panel 3 by means of a second fusible strip 1. Although this method can be used for altering existing garments, it is not well suited for use in manufacturing new garments because of the relative complexity of the process and the need to use two fusible strips. In addition, the seam has two free ends folded down on opposite sides, and both sides must be pressed, a relatively time-consuming procedure.

Accordingly, there is need for a practical method of manufacturing garments with seams that remain flat and smooth despite extensive wear and multiple launderings or cleanings. The present invention satisfies this need.

SUMMARY OF THE INVENTION

The present invention provides a method for making garments having seams that remain flat and smooth. In accordance with the invention, two panels of fabric are placed in position to be sewn together and a strip of double-sided fusible tape is placed along the desired seam line on the "wrong" side of one of the panels. Then the panels and the tape are sewn together, forming a seam. Next, the seam is folded flat against the wrong side of one of the panels with the tape between the seam and the panel. Finally, heat and pressure are applied by means of a steam iron or the like, fusing the tape and bonding the seam to the panel.

It will be appreciated that the present invention represents a significant advance in the manufacture of garments. Specifically, the attractive appearance of a garment made according to the invention is preserved throughout the life of the garment. Also, the stitching tends to last longer because it is protected from abrasion. Other aspects and advantages of the invention will become apparent from the following more detailed description taken in conjunction with the accompanying drawings.

DESCRIPTION OF THE PREFERRED EMBODIMENT

The present invention provides a practical method of manufacturing garments with seams that remain flat and smooth despite extensive wear and multiple launderings or cleanings.

Figure 1:
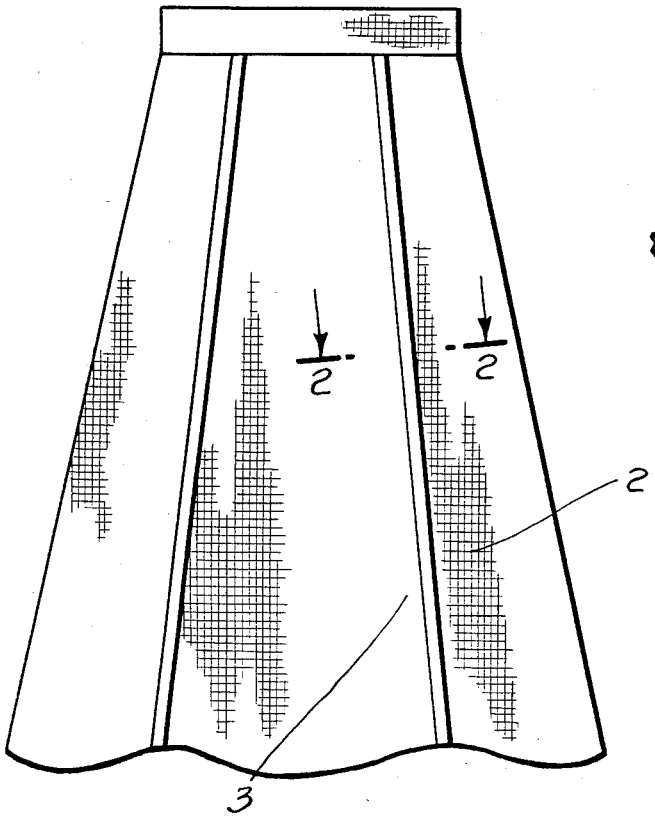
FIG. 1 is a plan view of a garment made according to the invention.
Figure 2:
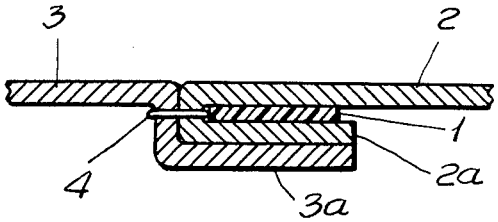
Fig. 2. PRIOR ART
FIG. 2 is a cross section of a seam along line 1—1 of FIG. 1.
Figure 3:
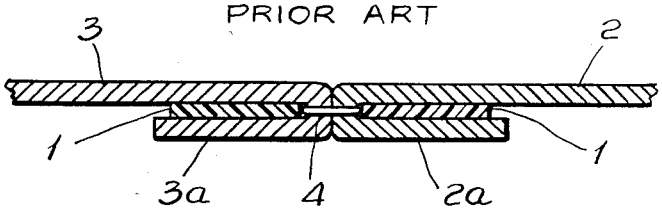
FIG. 3 is a cross section of a different kind of seam as disclosed in the prior art.

In accordance with the invention, a portion of a garment is formed from a panel of fabric 2 and another panel 3, as shown in FIG. 1. In one embodiment of the invention, panels 2 and 3 are positioned adjacent one another and sewn together by means of thread 4 as shown in FIG. 2. Then a strip 1 of double-sided fusible tape is positioned adjacent panel 2 along the seam formed by free ends 2*a* and 3*a* of panels 2 and 3. Next, the seam formed by free ends 2*a* and 3*a* is pressed against the "wrong side" of panel 2 with strip 1 between panel 2 and free end 2*a;* the heat pressure of the pressing cause the double-sided backing of strip 1 to fuse panel 2 and free ends 2*a* and 3*a* together, forming a flat seam that is resistant to puckering, waving, and billowing.

Figure 4:
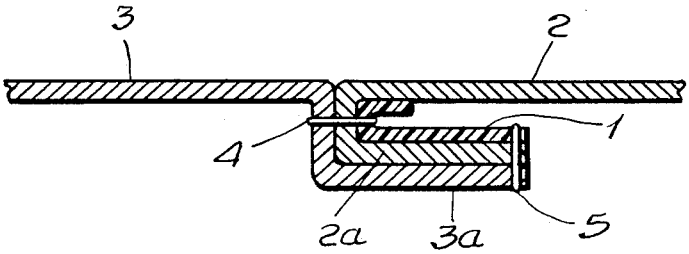
FIG. 4 is a cross section of a seam showing double-sided fusible tape forming part of the seam during the sewing operation.

Another embodiment of the invention, shown in FIG. 4, is similar to the embodiment shown in FIG. 2, and for convenience components in FIG. 4 that are similar to components in FIG. 2 are assigned the same reference numerals. As in the embodiment shown in FIG. 2, fabric panels 2 and 3 are positioned adjacent one another, but strip 1 of fusible tape is placed along the desired seam before sewing. Then panels 2 and 3 and strip 1 are sewn together by threads 4 and 5, forming a seam comprised of strip 1 and free ends 2*a* and 3*a* of panels 2 and 3. FIG. 4. As in the first embodiment, this seam is folded against the wrong side of panel 2 with strip 1 between panel 2 and the seam, and then the seam is pressed against panel 2, fusing strip 1 and free ends 2*a* and 3*a* to panel 2. The present invention provides a method of forming seams that is easy to use during manufacture of garments and that provides seams that remain flat and smooth throughout the life of the garment. Various modifications and changes may be made with regard to the foregoing detailed description without departing from the spirit of the invention.

I claim:

1. A method for making fused apparel seams, comprising the steps of:

positioning a first fabric segment adjacent a second fabric segment with a predetermined part of the first segment in overlapping alignment with a predetermined part of the second segment;

positioning a double-sided fusible strip adjacent a predetermined part of the first segment and in overlapping alignment with both segments;

sewing the fusible strip, the first segment, and the second segment together to form a seam, a first side of the seam comprising the fusible strip and a second side of the seam comprising the second segment;

folding the side of the seam comprising the fusible strip against the first segment with the fusible strip sandwiched between the seam and the first segment; and applying heat and pressure to the folded fabric to cause the fusible strip to fuse, thereby bonding the seam to the first segment.

2. A method for making fused apparel seams, comprising the steps of:

positioning a first fabric segment adjacent a second fabric segment with a predetermined part of the first segment in overlapping alignment with a predetermined part of the second segment;

sewing the first segment and the second segment together to form a seam;

positioning a double-sided fusible strip adjacent the seam;

folding the seam against the first segment with the fusible strip sandwiched between the seam and the first segment; and applying heat and pressure to the folded fabric to cause the fusible strip to fuse, thereby bonding the seam to the first segment.

* * * * *

UNITED STATES PATENT AND TRADEMARK OFFICE

CERTIFICATE OF CORRECTION

PATENT NO. : 4,561,128

DATED : December 31, 1985

INVENTOR(S) : Harry Zimmerman

It is certified that error appears in the above-identified patent and that said Letters Patent is hereby corrected as shown below:

Column 2, line 25, between "heat" and "pressure" insert --and--.

Signed and Sealed this

*Twenty-fifth* Day of *March 1986*

[SEAL]

*Attest:*

DONALD J. QUIGG

*Attesting Officer*

*Commissioner of Patents and Trademarks*